US007066823B1

(12) United States Patent
Bullis

(10) Patent No.: US 7,066,823 B1
(45) Date of Patent: Jun. 27, 2006

(54) ADJUSTABLE BOWLING BALL MEASURING AND MARKING DEVICE

(76) Inventor: Jody R Bullis, PSC 3 Box 883, APO AE, Wichita, KS (US) 09021

( * ) Notice: Subject to any disclaimer, the term of this patent is extended or adjusted under 35 U.S.C. 154(b) by 0 days.

(21) Appl. No.: 10/872,730

(22) Filed: Jun. 19, 2004

(51) Int. Cl.
*G01B 1/00* (2006.01)
*A63B 43/04* (2006.01)

(52) U.S. Cl. ..... 473/125; 33/510; 33/509

(58) Field of Classification Search ..... 473/125, 473/127; 33/509, 510
See application file for complete search history.

(56) References Cited

U.S. PATENT DOCUMENTS

| | | | | | |
|---|---|---|---|---|---|
| 1,175,612 | A | | 3/1916 | Cresse | |
| 3,161,041 | A | * | 12/1964 | Amburgey | 73/65.02 |
| 3,263,531 | A | * | 8/1966 | Sammons et al. | 408/97 |
| 3,276,134 | A | * | 10/1966 | Szwajkowski | 33/509 |
| 3,429,049 | A | * | 2/1969 | Snoddy | 33/510 |
| 3,835,545 | A | | 9/1974 | Taylor | 33/174 |
| 4,191,357 | A | * | 3/1980 | Nesbitt | 249/205 |
| 4,742,620 | A | | 5/1988 | Manker | 33/510 |
| 5,603,165 | A | | 2/1997 | Bernhardt et al. | 33/509 |
| 5,813,129 | A | | 9/1998 | Tseng | 33/509 |

* cited by examiner

*Primary Examiner*—William M. Pierce

(57) ABSTRACT

A device for determining the placement of gripping holes with respect to the pin and/or the center of gravity and/or the mass bias of a bowling ball has a meridian plane indicator, a vertical axis plane indicator and a horizontal axis plane indicator. The meridian plane indicator has a scale which determines the distance between placements of finger holes and a thumb hole for bowling balls. The vertical axis plane indicator has a scale which determines the distance from the horizontal axis plane to the location of the positive axis point. The horizontal axis plane indicator has two scales; the first determines the distance between the meridian plane and the vertical axis plane about the surface of the ball along the horizontal axis plane, the second scale determines the angular displacement of the meridian plane and the vertical axis plane. The vertical axis plane indicator is pivotally connected to the meridian plane indicator and has a means of temporarily affixing its position to the horizontal plane indicator. This allows the device to use cooperating scales to directly read the axis coordinates from a previously drilled ball, or to pre-set the device to a particular bowler's axis coordinates to speed up the process of marking a new ball in preparation for drilling. The device also has an adaptation to permit the drawing of various size arcs on the bowling ball surface to quickly and accurately locate the desired positive axis point.

2 Claims, 3 Drawing Sheets

ADJUSTABLE BOWLING BALL MEASURING AND MARKING DEVICE

CROSS-REFERENCE TO RELATED APPLICATIONS

Not applicable

STATEMENT REGARDING FEDERAL RESEARCH AND DEVELOPMENT

Not applicable

BACKGROUND

1. Field of Invention

The present invention relates to bowling ball accessories, and more particularly to a device adapted for use in marking and orienting bowling balls to provide coordinate markings thereon for use in accurately determining the proper location and disposition of the finger and thumb holes with respect to the pin and/or center of gravity and/or mass bias of a bowling ball.

2. Discussion of Prior Art

As the design and construction of the bowling ball continues to develop and evolve, it has become increasingly important to ensure the proper orientation of the finger and thumb holes in relation to one or more of the three physical properties of the modern bowling ball. These properties are:

Center of gravity; this is a radial projection on the surface of the ball of the physical center of gravity of the bowling ball before drilling the gripping holes. Placement of this helps determine the final static weights of the ball. These static weights, and thus the placement of the center of gravity, determine in part how the delivered bowling ball will react with the surface of the bowling lane.

Reference Pin; this indicates the center of the weight block along its longest axis. Once under rotational motion, as in the case of a rolling bowling ball, the weight block generates inertial forces which cause the rotational axis to migrate until the weight block is either in direct alignment with the rotational axis or orthogonal to the rotational axis. By aligning the reference pin and weight block in relation to the rotational axis initiated by the bowler, the drilling technician may determine how far the rotational axis will migrate. The effect of the rotational axis migration is seen on the surface of the bowling ball as spaced rings of lane conditioner picked up during the travel of the ball down the lane and is commonly referred to as the track flare of the ball. The greater the axis migration, the greater the spacing of the oil rings. Greater oil ring spacing ensures that clean ball surface is presented to the lane surface and increases the amount of friction the ball is able to generate with the lane surface. Once again, this will determine in part how the bowling ball reacts with the lane surface.

Mass bias or preferred spin axis; this is an indication on the ball surface of one end of the axis about which the ball would experience equilibrium while under rotational motion. Rotation about any other axis will cause the rotational axis to migrate toward the preferred spin axis or mass bias location, thus producing the track flare which bowlers see on their ball. This too helps determine how much and where on the lane the ball will hook.

In practice, one or more of these three ball properties are placed at a desired distance(s) from the axis the ball rotates about as it leaves the bowler's hand during delivery. The location on the surface of the ball at the end of this axis which would be visible to the bowler during delivery is know as the positive axis point. The positive axis point for a given bowler is not influenced by the balance or layout of the ball, and can therefore be easily acquired from any ball the bowler currently uses. Once the bowler's positive axis point is located on the ball surface prior art tools such as are disclosed in U.S. Pat. No. 3,161,041 to Amburgey (1964), or U.S. Pat. No. 5,603,165 to Bernhardt and Laskow (1997) are used to measure the distance left or right of the center of the bowler's grip and the distance up or down from that line. The left/right measurement is normally referred to as the horizontal coordinate of the bowler's axis point. The measurement up/down is referred to as the vertical axis coordinate of the bowler's axis point. The device disclosed in U.S. Pat. No. 5,813,129 to Tseng could also be used to obtain these measurements, however this device is not commercially available at this time.

Using any of the prior art tools for this task starts by drawing a grip center line which bisects the thumb hole and extends through the center of the bridge between the finger holes. The tool must then be repositioned to measure and mark the midpoint of the grip center line between the gripping face of the thumb hole and the gripping faces of the finger holes. The tool must then be repositioned again and a second line drawn perpendicular to the grip center line from the midpoint of the grip center line and generally toward the bowler's positive axis point. The tool must then be repositioned again to draw a third line orthogonal to the second line and passing through the marked positive axis point. The tool must then be used to measure the length of the second line segment which connects the midpoint of the grip and the third drawn line; this is the horizontal axis coordinate and this line defines the horizontal axis plane. The length of third line segment connecting the second line to the positive axis point must then be measured to provide the vertical axis coordinate; this line defines the vertical axis plane. Using prior art tools to obtain these measurements is a very time consuming process.

In preparation to drill the new ball, it is common practice for the drilling technician to first determine the desired location of the bowler's positive axis point relative to one or more of the ball's marked properties (reference pin, center of gravity, or mass bias.) For instance, it may be that to achieve the desired reaction the reference pin should be 4 inches from the positive axis point and the center of gravity should be 5 inches from the positive axis point. To achieve this result using prior art tools the drilling technician must measure the desired radius from the desired ball property indicator (reference pin, center of gravity, or mass bias); pencil a small mark on the ball surface at that point; rotate the tool slightly; measure and mark again. After this process has been repeated a number of times, the series of marks will indicate the desired arc. The drilling technician must then sketch the complete arc. The technician's skill in sketching a smooth arc, and the number of measured marks created on the ball surface will determine the accuracy of the arc. When locating the bowler's positive axis point with regard to only a single ball property indicator only a single arc is needed. When locating a desired positive axis point with reference to 2 of the ball property indicators, 2 arcs must be drawn. The positive axis point will then be located at one of the spots where the 2 arcs cross. Drilling layouts referencing all 3 of the ball property indicators require 3 arcs to be drawn. Although the device in U.S. Pat. No. 5,603,165 to Bernhardt and Laskow (1997) has a provision for drawing an accurate arc, an arc of radius 3⅜ inches is the only size which may be directly drawn. Drawing arcs of radii other than 3⅜ inches on the ball surface is accomplished using the technique described above when employing any of the prior art devices. Obtaining an accurate arc shape of desired radius using prior art tools is very tedious and time consuming.

Once the desired location of the positive axis point has been determined the drilling technician must use the bowler's axis coordinates to determine the location and orientation of the gripping holes in the bowling ball. This process involves drawing the same series of lines as described previously to find the horizontal and vertical axis coordinates for a bowler. Once again this operation consumes a large amount of time. Additional time may be required if the determined location of the gripping holes could cause undesirable results such as drilling too close to the reference pin, or an excessive amount of static imbalance within the ball. In these cases the same positive axis point location is used, but the orientation of the axis coordinate lines are rotated slightly to allow for a different orientation of the gripping holes while still retaining the desired rotational characteristics of the bowling ball.

A second layout technique uses the angle created by a line connecting the reference pin and center of gravity and a line connecting the reference pin and positive axis point, and the distance from the reference pin to the positive axis point as a way of locating the desired positive axis point. Of the prior art tools the device disclosed in U.S. Pat. No. 5,603,165 to Bernhardt and Laskow as this is the only device currently commercially available which has provisions for accurately marking angular measurements on the surface of a bowling ball. The procedure for drawing an angle using this tool is to orient the tool in the desired position to draw the reference pin to center of gravity line; draw this line; orient the tool to measure an angle with the reference pin at the vertex and of the desired offset from the reference pin to center of gravity line; mark the desired angular displacement; re-orient the tool to draw the angled line from the reference pin; measure and mark the desired distance of the positive axis point from the reference pin along the angled line. Once again, this takes more time than should be necessary to accomplish this task.

As in the previous case, once the location of the positive axis point is determined the axis coordinates are used to determine the location and orientation of the gripping holes. Also as in the previous case, if the determined location of the gripping holes is not acceptable then re-measuring from the desired positive axis point at a slightly rotated orientation is required. Much time may be wasted using prior art tools to achieve acceptable layouts with respect to the various physical properties of the bowling ball.

SUMMARY

In accordance with the present invention a ball measuring device comprises two rigid semi-circular frame members with graduated faces and inner peripheries adapted for engagement with the ball surface, connected at their ends by a flexible means, a third graduated frame member of arcuate shape, one end being rigidly affixed perpendicularly to a semi-circular frame member the opposite semi-circular frame member possessing a means of temporarily affixing to the third graduated frame member, and a means of holding one point of a semi-circular frame member over a point on the ball surface while permitting the device to pivot about this point.

OBJECTS AND ADVANTAGES

Accordingly, besides the objects and advantages of the ball measuring device described in my above patent, several objects and advantages of the present invention are:

(a) to provide a device which provides accurate measurements to determine the placement of finger and thumb holes.

(b) to provide a device which provides an accurate and quick method of drawing arcs of various size radii on the ball surface.

(c) to provide a device which provides an accurate and quick method of drawing angular displacements on the ball surface.

(d) to provide a device which utilizes cooperating scales to directly provide axis coordinates.

(e) to provide a device which will permit the visualization of finger and thumb hole placement relative to a bowler's positive axis point, prior to drawing the grip center line, grip center point, horizontal axis line, or vertical axis line.

From the following drawings, and detailed description further objects and advantages of the present invention will become apparent to those skilled in the art.

DRAWING FIGURES

REFERENCE NUMERALS IN DRAWINGS

Figure 1:
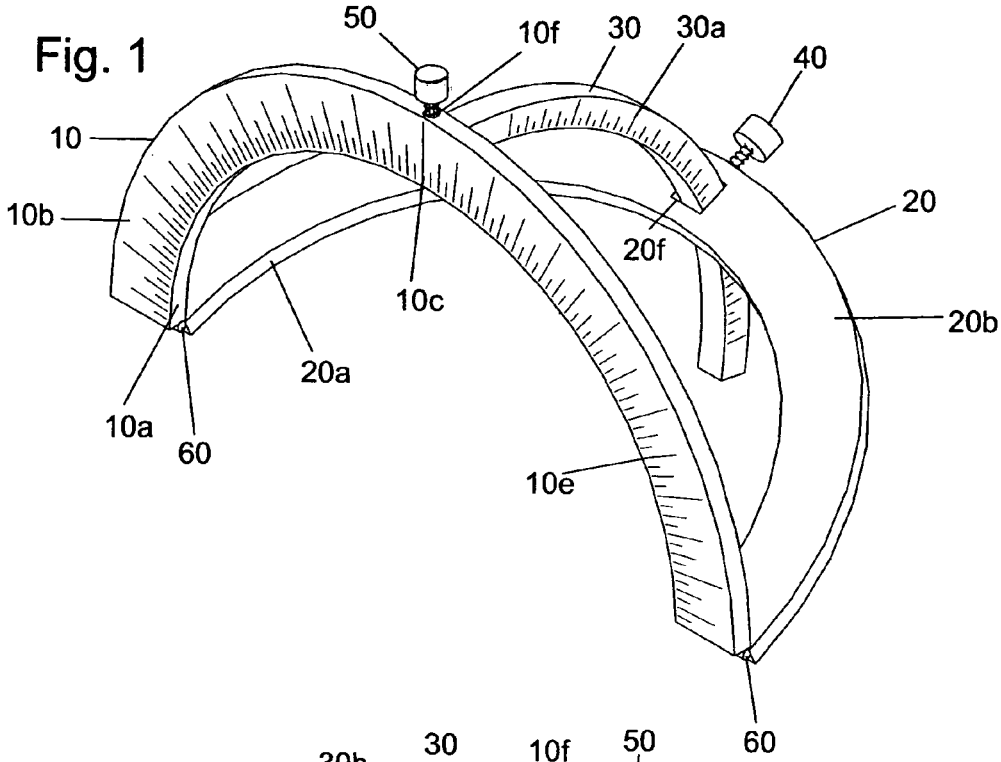
FIG. 1 is a right front elevation view of the ball-marking device.
Figure 2:
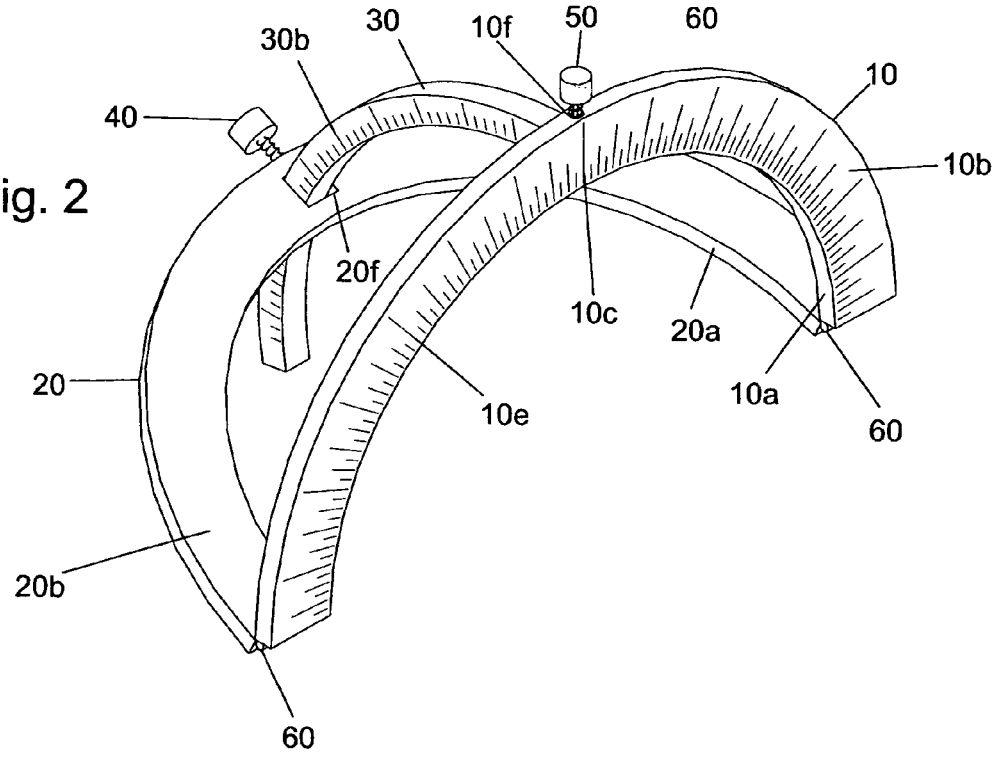
FIG. 2 is a left front elevation view of the ball-marking device.
Figure 3:
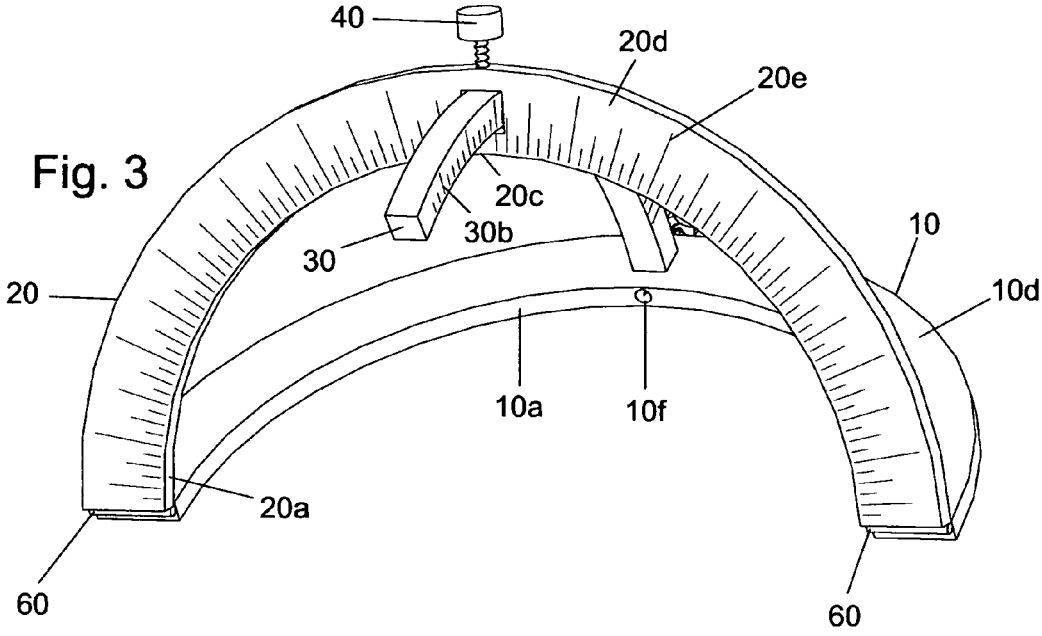
FIG. 3 is a view from the lower left rear of the ball-marking device.

10 Frame member
10*a* Bottom face of frame 10
10*b* Front (outer) face of frame 10
10*c* Midpoint of frame 10
10*d* Back (inner) face of frame 10
10*e* Scale on face 12 of frame 10
10*f* Hole for the pivot assembly
20 Pivoting frame member
20*a* Bottom face of frame 20
20*b* Front (inner) face of frame 20
20*c* Midpoint of frame 20
20*d* Back (outer) face of frame 20
20*e* Scale of face 20*d* of frame 20
20*f* Cutout in frame 20 for frame 30
30 Frame member affixed to frame 10
30*a* Inch scale face of frame 30
30*b* Degree scale face of frame 30
40 Thumbscrew
50 Retractable anchor device
50*a* Knob
50*b* Spring
50*c* Shaft with sharp point
60 Hinge or other flexible attachement

DESCRIPTION

Referring to FIGS. 1, 2, 3, 4, and 5 the ball marking device there illustrated is generally in the form of a frame work formed of two rigidly interconnected frame members 10 and 30; moveable frame member 20 attached to frame member 10 via hinge means 60, with a cut-out 20*f* permitting frame member 30 to pass through the midpoint of frame 20, and with a means of temporarily affixing frame members 20 and 30 together shown here as thumbscrew 40. Further there is a means for anchoring the midpoint of frame 10 to a selected point on the surface of a bowling ball while allowing the device to pivot about this point; retractable anchor device 50.

Frame members 10 and 20 are both of a rigid semi-circular nature and a predetermined cross section. Each has a semi-circular inner periphery 10*a* and 20*a* respectively which is adapted for engagement with the surface of a bowling ball. Each also has a distance scale 10*e* and 20*e* respectively, coupled to a face adjacent the respective semi-circular inner periphery. In this particular embodiment, the scales are illustrated with inch units, however a metric or other measurement system could be imposed. The apex of each arc is designated with a zero or midpoint 10*c* and 20*c* respectively. The scales 10*e* and 20*e* are equally fanned out from the midpoints 10*c* and 20*c* respectively.

Figure 4:
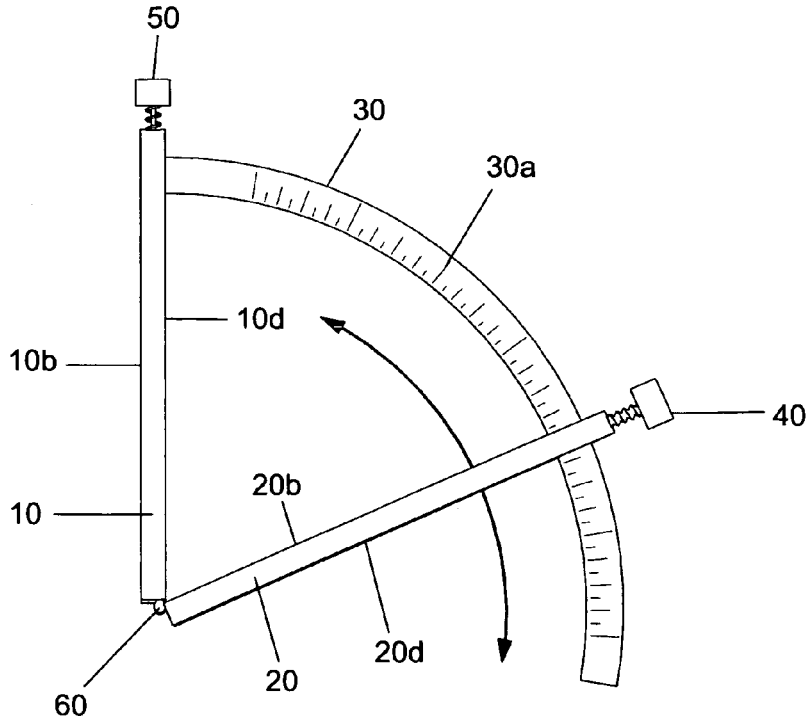
FIG. 4 is a right hand side view of the ball-marking device.
Figure 5:
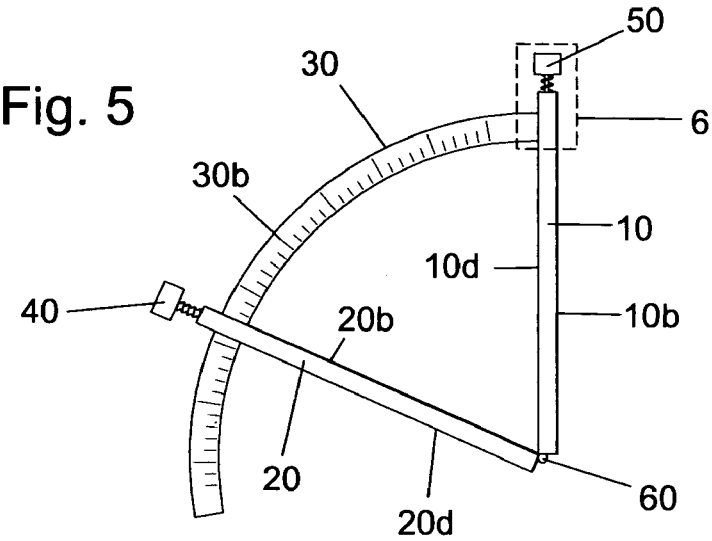
FIG. 5 is a left hand side view of the ball-marking device with the area shown in FIG. 6 indicated.

The two frame members 10 and 20 are connected at their ends by a means 60 which permits their relative position to vary from approximately 5 degrees to approximately 180 degrees as shown in FIG. 4. In the preferred embodiment means 60 is accomplished by a simple hinge. This could also be accomplished by utilization of a flexible connecting material such as plastic, rubber, or cloth to permit the required range of motion between the frame members.

Frame member 30 is also of a rigid semi-circular nature and predetermined cross-section. Frame 30 is rigidly affixed orthogonal to face 10*d* of frame member 10 at the midpoint 10*c* of frame 10 such that frame member 30 passes through the cutout 20*f* in frame 20 at the midpoint 20*c*. Frame 20 may be temporarily affixed to frame 30 by means of a friction clamp. The current preferred embodiment of this clamp is in the form of thumbscrew 40, but any means of providing temporary immobility to frame 20 would be acceptable. An inch scale 30*a*, and an angular degree scale 30*b* are coupled to frame 30. In the embodiment shown the right hand side scale 30*a* is in inch units, and the left hand side 30*b* provides the angular measurement of frame 10 relative to frame 20. Any embodiment which can provide distance and angular measurements would be equally acceptable.

Figure 6:
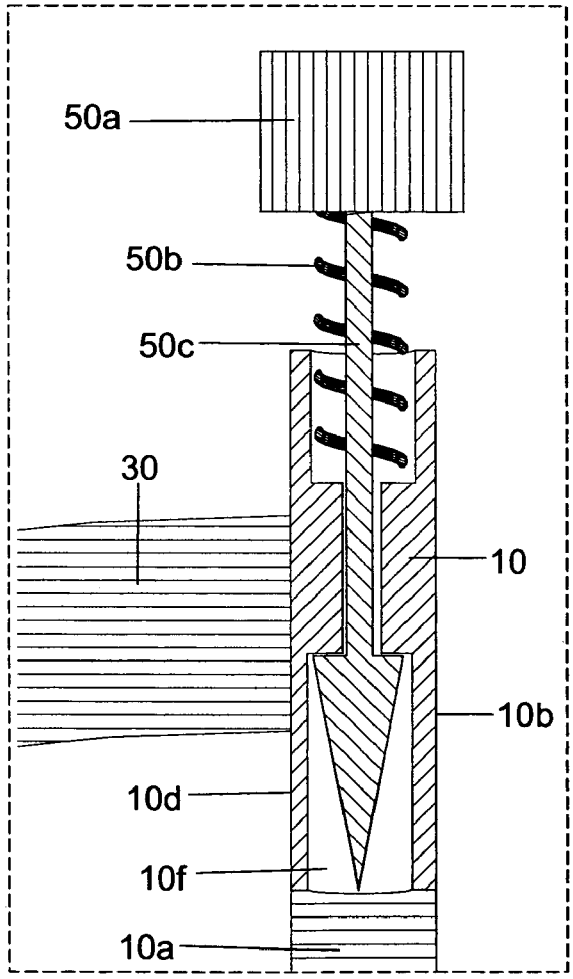
FIG. 6 shows a cutaway detail view of one possible arrangement of the retractable pivot assembly.

FIG. 6 shows a cutaway view of one possible arrangement for a device to anchor the midpoint 10*c* of frame 10 to the bowling ball surface while allowing the device to pivot about this point. In this embodiment, the anchor device 50 is composed of a shaft 50*c* which has a sharp point meant to project a short distance into the ball surface and thereby provide a pivotable interface with the ball surface; a spring 50*b* serves to retract the shaft 50*c* from the ball surface when not needed; and a knob 50*a* for the technician to press down upon when the anchoring capability is desired. In this currently preferred embodiment anchor device 50 resides within a cutout or hole 10*f* of frame 10. Other possible embodiments of anchor device 50 could include a suction cup type attachment, or a rubber or plastic material able to provide a non-slip attachment with the ball surface.

As shown in FIGS. 1–5 the tool had been originally conceived with scale 20*e* on outer face 20*b* of frame 20. Since this tool has been reduced to practice it has become evident that scale 20*e* would be more easily utilized if placed on the inside face 20*d* of frame 20. To ensure the greatest flexibility in usage scales could be provided on frame faces 10*b*, 10*d*, 20*b*, and 20*d*.

Advantages:

From the description above a number of advantages of my bowling ball measuring and marking tool become evident:

(a) When obtaining a bowler's axis coordinates from a previously drilled ball, the technician need only orient the tool once; axis coordinates may then be read directly from the various scales on the tool.

(b) Accurate arcs of radii up to 6.75 inches may be quickly drawn in a manner similar to using a compass.

(c) Angle layouts can be achieved quickly by setting the tool to the desired angle, orienting it once on the ball and marking the appropriate locations.

(d) Once a desired PAP location is determined on a new ball the tool may be set to the bowler's axis coordinates and then used to visualize just where the gripping holes will be located. Location of the gripping holes may be adjusted easily by rotating the tool about the PAP resulting in a very large time savings.

Operation:

The manner of usage for my bowling ball measuring and marking tool is similar to the prior art tools currently in use. The principal operational differences and advantages lie with the five novel features of my tool. Specifically these features are the hinge means 60 to connect frame members 10 and 20, the retractable anchor assembly 50, the friction clamp mechanism 40, distance scale 30*a* on frame member 30 and angular degree scale 30*b* on frame 30.

The operational advantages gained by the inclusion of these features are demonstrated in a few of the routine tasks ball drilling technicians must perform in the course of their work. For instance the task of obtaining the coordinates for a given bowler's. Prior art tools necessitate the re-orientation of the tool a number of times, drawing at least three orthogonal lines, and finally measuring segments of two of the three lines. When using my tool, scale 10*e* is aligned with the grip center and scale midpoint 10*c* at the grip center. Adjusting frame member 20 so that scale 20*e* passes over the positive axis point allows the technician to directly read the axis coordinates from scales 30*a* and 20*e*.

The task of drawing arcs on the ball surface is far faster and more accurate using my tool as well. Prior art involved multiple measurements and sketching an arc. My device achieves the drawing of arcs by depressing the retractable anchor assembly 50 over the desired vertex of the arc. A marking pencil is then held in contact with the ball surface next to scale 10*e* at the length of the desired arc radius. Pivoting the tool about anchor 50 then provides an accurate arc very quickly.

The angular layouts are also achieved far faster using my tool. Prior art tool involve draw a line, measure an angle, draw a second line and then measure and mark a distance along that line to find the desired positive axis points. Technicians using my tool would only need to set frame 20 to the correct position using the angular degree scale 30*b*. Lock frame 20 in place using thumbscrew 40. Position the tool once with scale 10*e* connecting the reference pin and center of gravity of the ball and left hinge 60 at the reference pin. Measure the desired distance from the reference pin using scale 20*e* and mark the desired location of the positive axis point.

Visualization of gripping hole placement once a desired positive axis point location has been determined is also much easier with this tool. Prior art tools have no way of allowing the drilling technician to see where the holes will be located until they have drawn a series of orthogonal lines to determine the correct location and orientation of the grip center and grip center line. When using my device, frame-20 is set to provide the correct axis coordinates using scales 30*a* and 20*e*. For instance if a particular bowler's axis coordinates are right 4.5 inches and up 0.75 inches, frame face 20*b* would be aligned with the 4.5 inch mark on scale 30*a*. With frame 20 locked in place using thumbscrew 40 the 0.75 inch mark of scale 20*e* would be placed over the desired positive axis point. Frame face 10*b* then delineates the grip center line, and scale midpoint 10*c* marks the grip center. For the technician to visualize the hole placement he/she need only look ½ of the span distance on either side of midpoint 10*c*. If a hole will be too close to the reference pin or the center of gravity the technician only needs to rotate the device about the desired positive axis point to determine new gripping hole locations while retaining the desired positive axis point.

CONCLUSION

Accordingly, the reader will see that the ball measuring and marking tool of this invention can be used to perform any of the tasks of prior art tools. In addition, it can perform a variety of routine tasks faster and more accurately than prior art tools.

Although the description above contains specifications, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A device for determining finger hole placement of bowling balls comprising;

a first element defining a meridian plane on a bowling ball; first scale means for enabling distance determination between placement of holes in the bowling ball, said first scale means coupled with said element defining said meridian plane;

a second element defining a second plane about the surface of the ball, second scale means for enabling distance determination along the said second plane, said second scale means coupled with said second element;

Said second element pivotally coupled with said first element;

a third element rigidly coupled to said first element, and passing through a cutout in said second element; third scale means for enabling distance to be determined between said first element and said second element, fourth scale means for enabling an angular measurement between the said meridian plane defined by said first element and said second plane defined by said second element, said third and fourth scale means coupled with said third element;

a fourth element which provides a means for temporarily rigidly coupling said second element with said third element, said fourth element also being disengagable to permit said second element to move relative to said third element;

a fifth element which provides a means for maintaining the relative position of a point on said first element with a selected point on the surface of a bowling ball while allowing the device to pivot about said point, said fifth element also being disengageable so as to permit movement of said first element with respect to the surface of a bowling ball.

2. A method of determining the placement of gripping holes with respect to a bowler's desired positive axis point comprising;

providing a bowling ball and a template having a means for marking arcs of varying size radii on the ball surface;

said template having an element defining a meridian plane on a bowling ball, first scale means for enabling distance determination between placement of holes in the bowling ball, said first scale coupled with said element and in said meridian plane;

a second element defining a second plane containing the desired positive axis point, second scale means for enabling vertical distance determination of the axis point said second scale coupled with said second element;

a third element defining a third plane midway between the gripping holes with orientation orthogonal to said meridian plane, a third scale means for enabling distance determination between said meridian plane and said second plane, said third scale means coupled with said third element;

a means for temporarily securing said second element to said third element;

placing said template on said bowling ball;

marking arcs to locate the desired positive axis point;

adjusting said second element to ensure said second plane is located a predetermined distance from said meridian plane;

utilizing means for securing second element to third element;

positioning a predetermined measurement from said second scale at said location of the positive axis point; and utilizing said first scale means to define desired positions for drilling holes in the bowling ball.

* * * * *